US006593899B2

(12) United States Patent
Ha et al.

(10) Patent No.: US 6,593,899 B2
(45) Date of Patent: Jul. 15, 2003

(54) HELICAL ANTENNA STRUCTURE IN A MOBILE TERMINAL

(75) Inventors: Dong-In Ha, Seoul (KR); Wan-Jin Choi, Kyonggi-do (KR); Dong-Hwan Kim, Seoul (KR); Jun-Kyu Kang, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/947,687

(22) Filed: Sep. 6, 2001

(65) Prior Publication Data

US 2002/0047813 A1 Apr. 25, 2002

(30) Foreign Application Priority Data

Oct. 18, 2000 (KR) ..... 2000-61250

(51) Int. Cl.[7] ..... H01Q 1/36
(52) U.S. Cl. ..... 343/895; 343/702

(58) Field of Search ..... 343/702, 895, 343/872, 873

(56) References Cited

U.S. PATENT DOCUMENTS 6,166,707 A * 12/2000 Painter et al. ..... 343/872
6,292,156 B1 * 9/2001 Openlander ..... 343/895
6,300,913 B1 * 10/2001 Davidson ..... 343/722

* cited by examiner

*Primary Examiner*—James Clinger
(74) *Attorney, Agent, or Firm*—Dilworth & Barrese, LLP

(57) ABSTRACT

There is provided a helical antenna structure, which exhibits minimal influence from contact with a human body in a mobile terminal. In the helical antenna structure, a cap protrudes from an upper end of the mobile terminal, and a winding coil is formed within the cap, which is spaced from an outer surface of the cap substantially the same distance from a bottom part of the cap to a top part of the cap.

4 Claims, 9 Drawing Sheets

HELICAL ANTENNA STRUCTURE IN A MOBILE TERMINAL

PRIORITY

This application claims priority to an application entitled "Helical Antenna Structure in Mobile Terminal" filed in the Korean Industrial Property Office on Oct. 18, 2000 and assigned Serial No. 2000-61250, the contents of which are hereby incorporated by reference.

BACKGROUND OF THE INVENTION

1. Field of the Invention

The present invention relates generally to a mobile terminal, and in particular, to an antenna structure in a mobile terminal.

2. Description of the Related Art

In general, a mobile terminal has a helical antenna formed in an outward protrusion and a whip antenna. When the whip antenna is contained in the mobile terminal, the helical antenna is operational, and when the whip antenna is extended, the whip antenna is operational.

FIGS. 1A and 1B illustrate the operations of antennas in a conventional mobile terminal. When a whip antenna 100 is contained in the terminal as shown in FIG. 1A, an RF signal is transmitted/received through a helical antenna 102 formed within a cap 106 which protrudes outward from a terminal 104. When the whip antenna 100 is pulled out as shown in FIG. 1B, the RF signal is transmitted/received through the whip antenna 100.

As shown in FIGS. 1A and 1B, the helical antenna is comprised of a winding coil and a cap covering the winding coil. The diameter of a top part TP equals that of a bottom part BP in the winding coil. Since the cylindrical winding coil is near to the outer surface of the cap, the helical antenna is significantly affected when it makes contact with a human body.

When the helical antenna operates, a high voltage is induced to the top part TP of the winding coil, and therefore this high voltage contacts cap 106 adjacent to the top part TP and a human body greatly influences the antenna's characteristics.

SUMMARY OF THE INVENTION

It is, therefore, an object of the present invention to provide a helical antenna structure, where the influence of a human body on the antenna's characteristics is prevented in a mobile terminal.

To achieve the above object, there is provided a helical antenna structure of a mobile terminal, which is minimally influenced by a human body. In the helical antenna structure, a cap protrudes from the upper end of the mobile terminal, and a winding coil is formed within the cap, which is spaced from an outer surface of the cap substantially the same distance from a bottom part of the cap to a top part of the cap.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described hereinbelow with reference to the accompanying drawings. In the following description, well-known functions or constructions are not described in detail since they would obscure the invention in unnecessary detail.

Figure 1A:
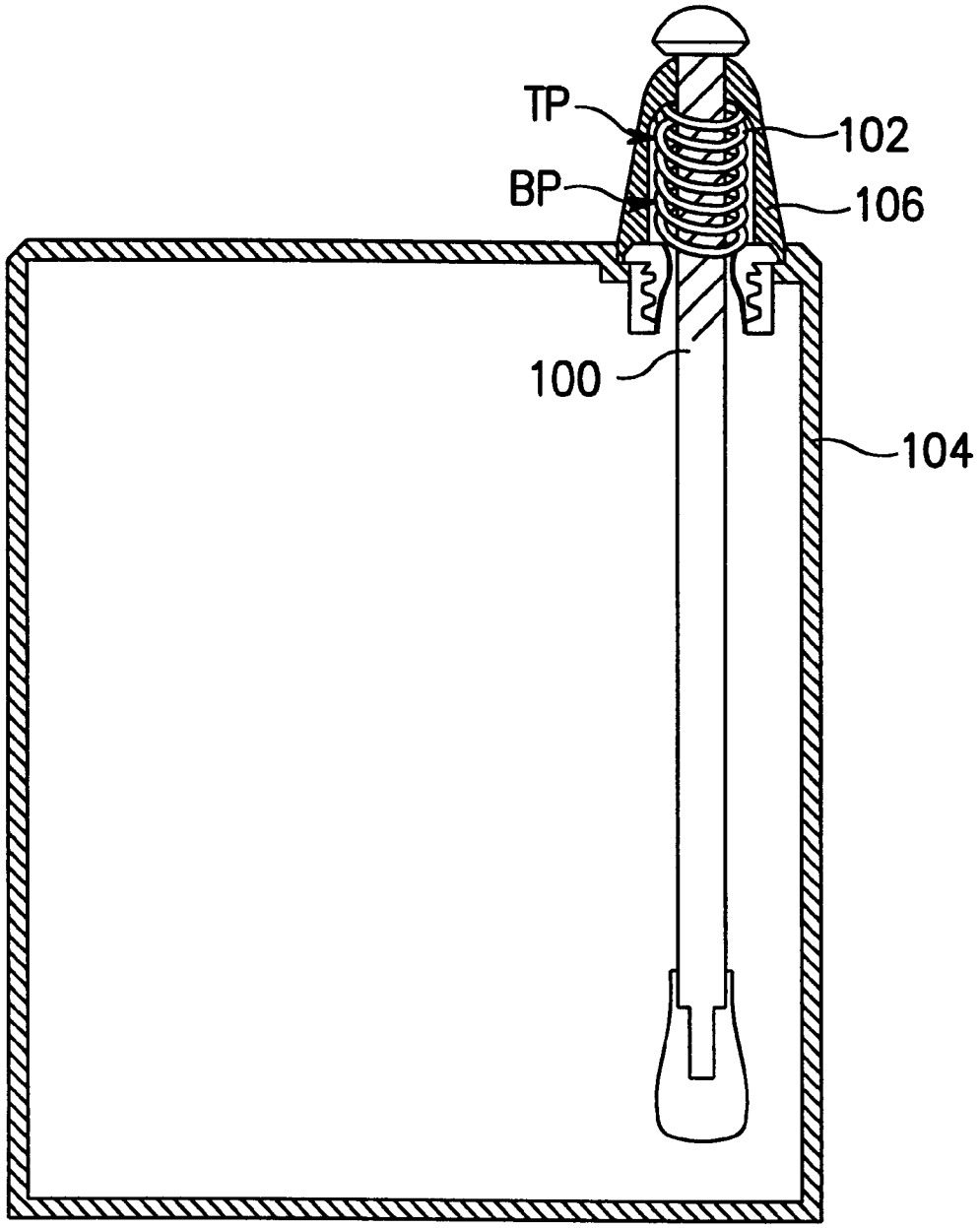
FIGS. 1A and 1B illustrate the operating state of a conventional antenna in a mobile terminal.
Figure 1B:
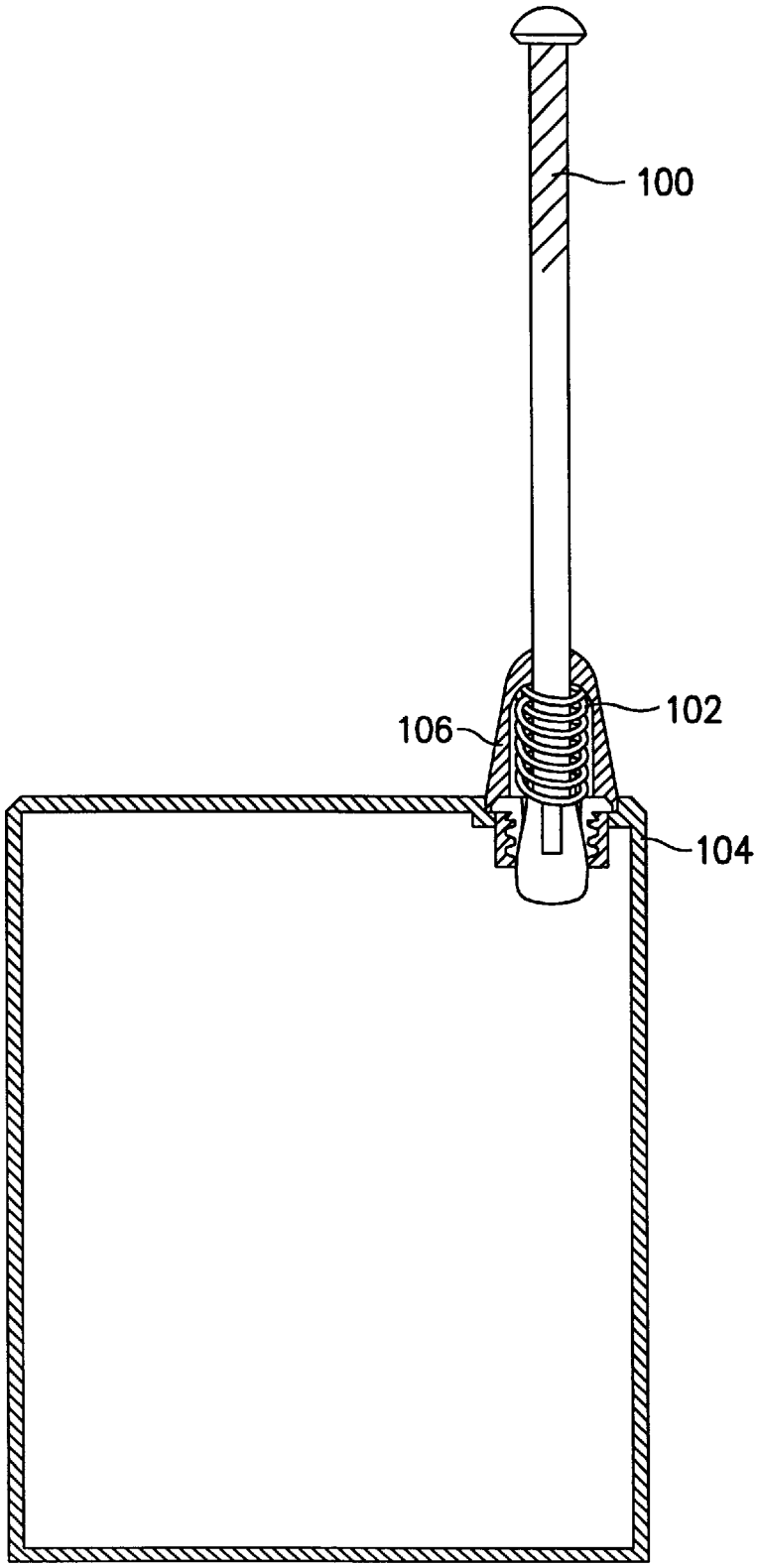
Figure 2:
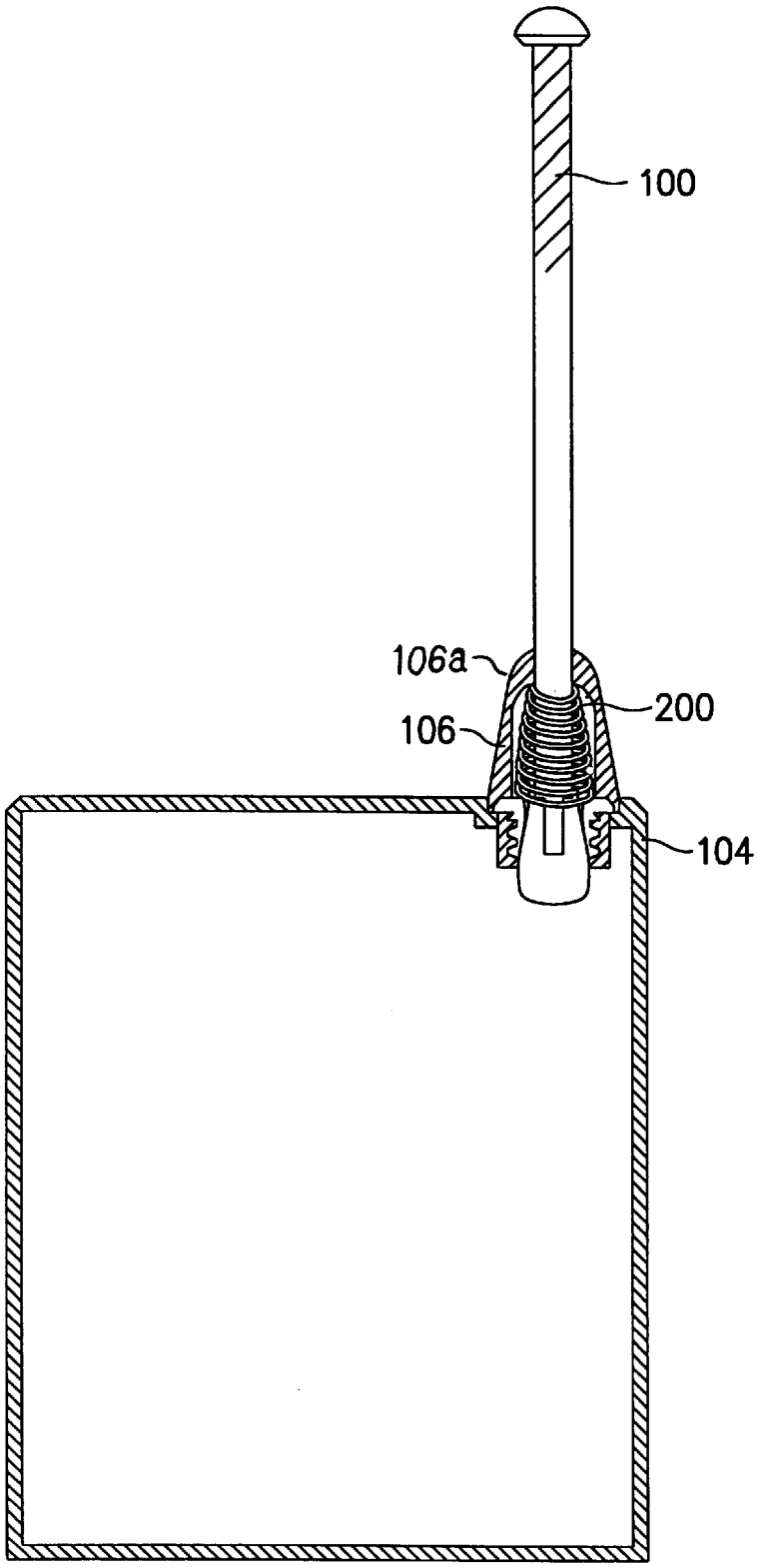
FIG. 2 illustrates a helical antenna structure in a mobile terminal according to an embodiment of the present invention.

FIG. 2 illustrates a cone-shaped helical antenna for a mobile terminal, according to an embodiment of the present invention. Referring to FIG. 2, a helical antenna 200, according to the embodiment of the present invention, is comprised of the cap 106 protruding outward from an upper end of the terminal 104 and a winding coil with a diameter decreasing from a bottom part BP to a top part TP to increase the distance between the winding coil and the outer surface of the cap 106, so that the distance or space between the outer surface of the cap 106*a* and the coil 200 remains substantially the same along the length of coil 200. In accordance with the embodiment of the present invention, the winding coil is formed into a cone shape so that the diameter of the coil is decreased at every turn from the bottom part BP to the top part TP, thereby maximizing the distance between the top part TP where a high voltage is induced and the outer surface of the cap 106. Therefore, the antenna's characteristics caused by contact between a human body and the outer surface of the cap 106, especially near the top part of the cap 106, is minimized.

Figure 3:
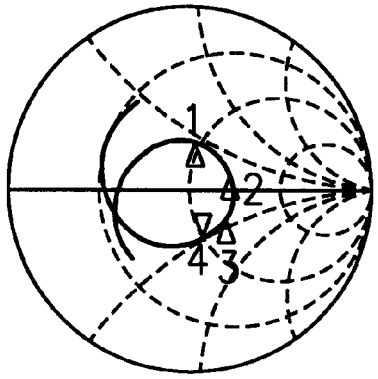
FIG. 3 is a graph showing the impedance matching state of the conventional helical antenna formed into a cylindrical winding coil.
Figure 3:
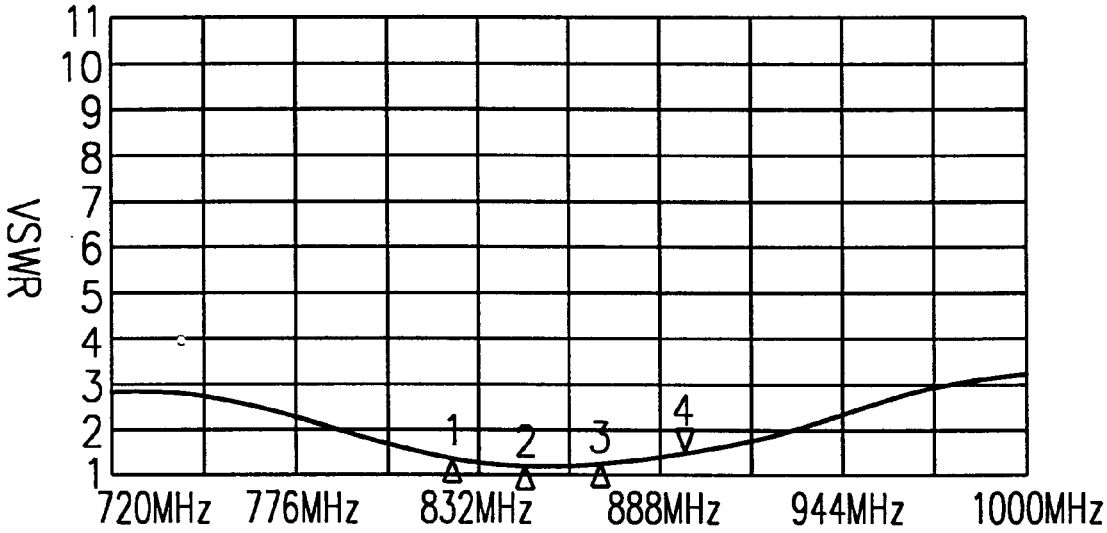
Figure 4:
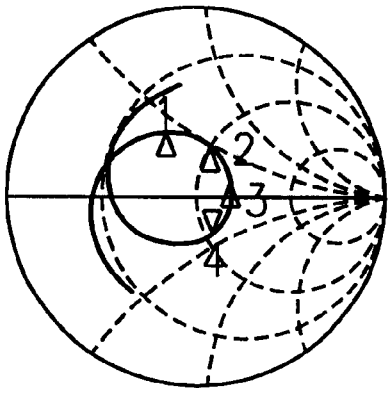
FIG. 4 is a graph showing the impedance matching state of the helical antenna formed into a conical winding coil, according to the embodiment of the present invention.
Figure 4:
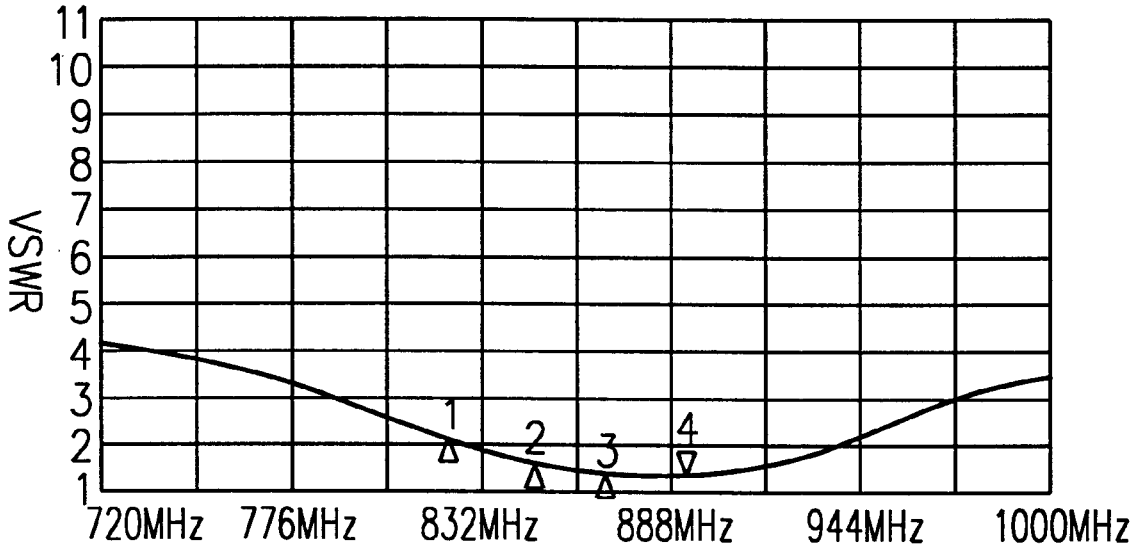

FIGS. 3 and 4 are graphs respectively showing the impedance matching states in free space of the conventional helical antenna formed into a cylindrical winding coil (FIG. 3) and the helical antenna formed into a conical winding coil according to the embodiment of the present invention (FIG. 4). As noted from FIGS. 3 and 4, both the antennas have VSWRs of 2 or below, which are indicative of excellent antenna characteristics.

Figure 5:
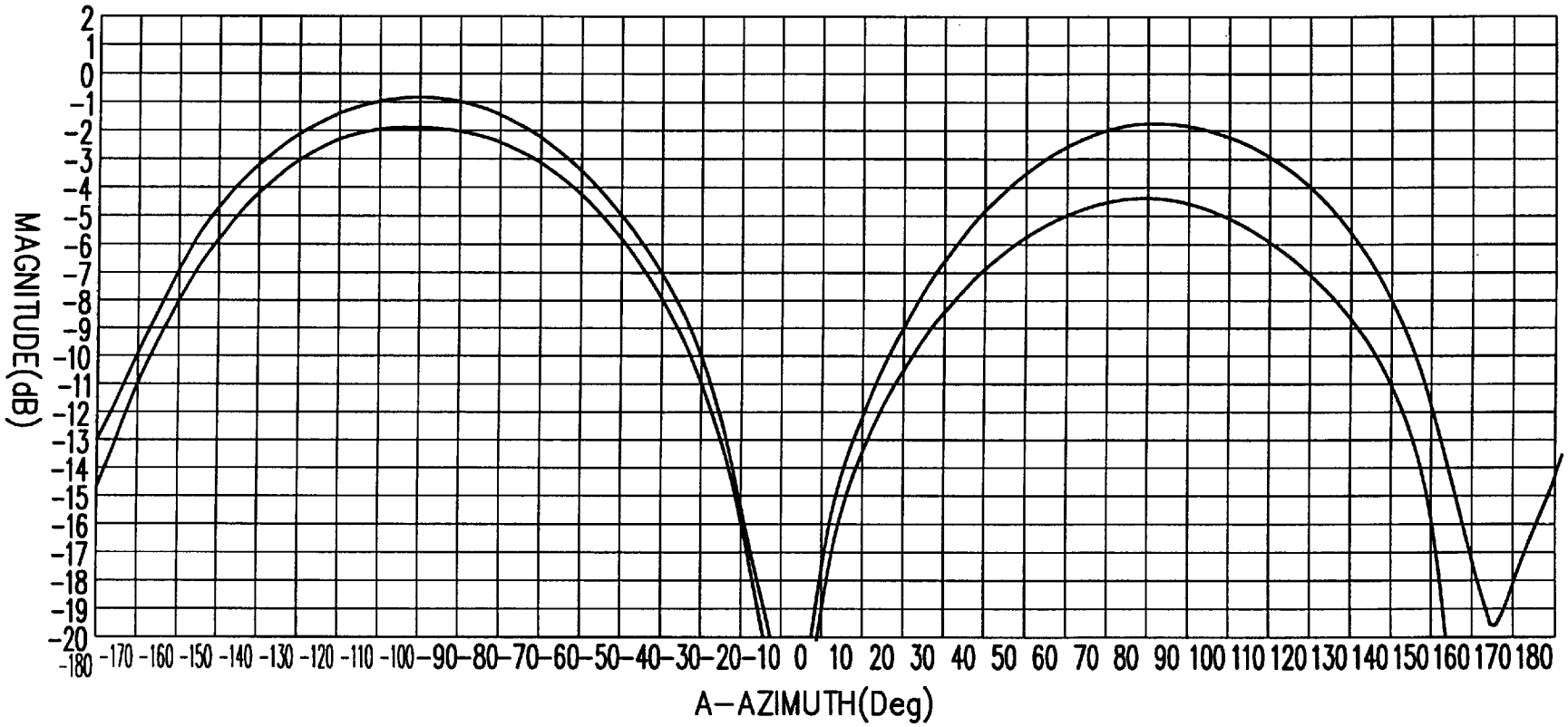
FIG. 5 is a graph showing the omni-directional radiation characteristic of the conventional helical antenna formed into a cylindrical winding coil.
Figure 6:
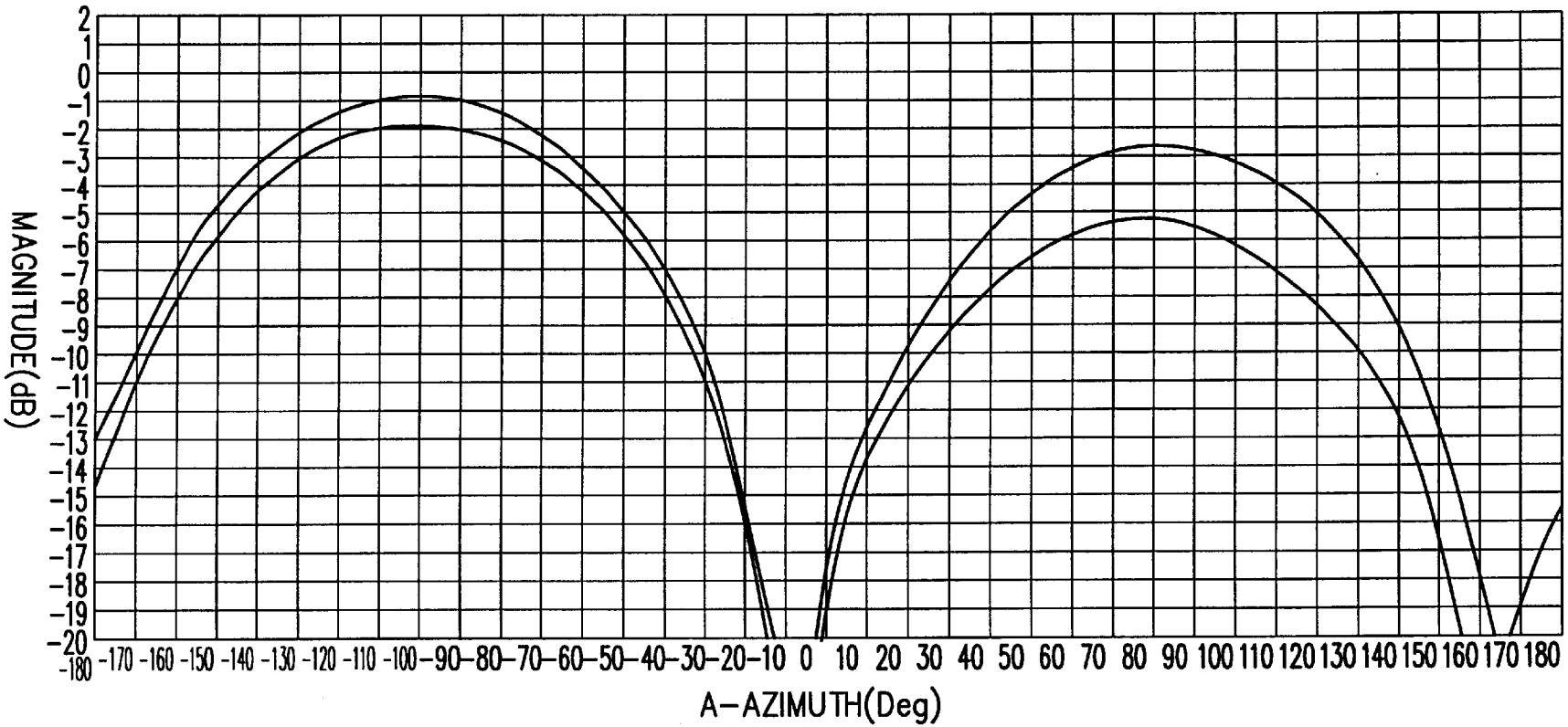
FIG. 6 is a graph showing the omni-directional radiation characteristic of the helical antenna formed into a conical winding coil according to the embodiment of the present invention.

FIGS. 5 and 6 are graphs respectively showing the omni-directional radiation characteristics of the conventional helical antenna formed into a cylindrical winding coil (FIG. 5) and the helical antenna formed into a conical winding coil, according to the embodiment of the present invention (FIG. 6). As noted from FIGS. 5 and 6, both the antennas are almost the same in terms of antenna radiation characteristics in free space. That is, there is little difference between the antenna gains of the two antennas.

Figure 7:
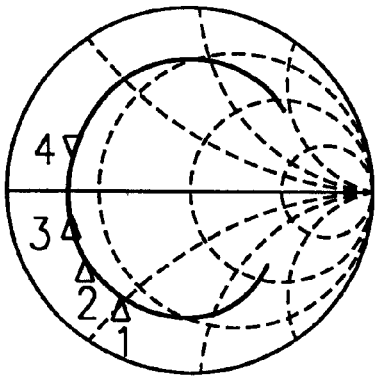
FIG. 7 is a graph showing the impedance matching state of the conventional helical antenna formed into a cylindrical winding coil when it contacts a human body.
Figure 7:
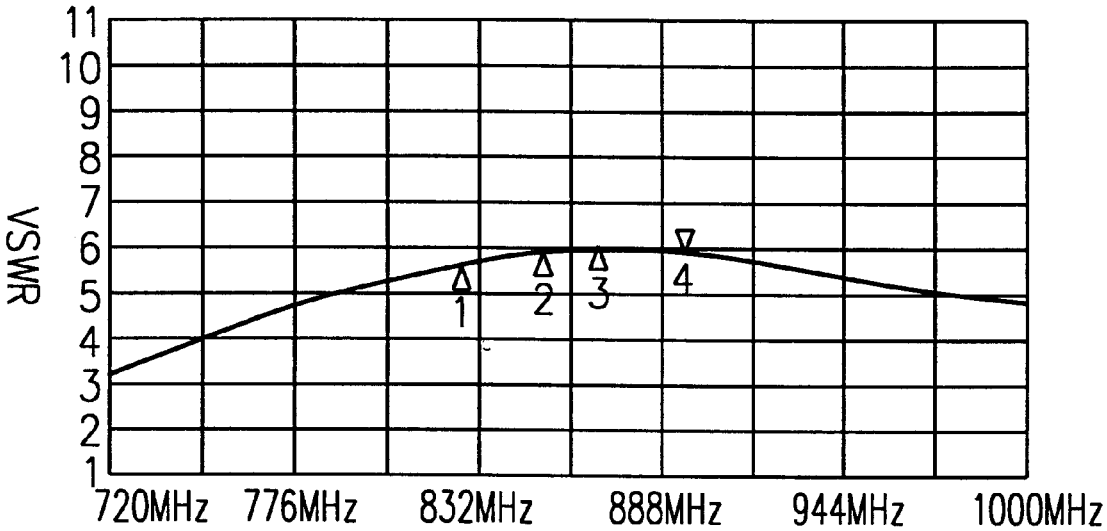
Figure 8:
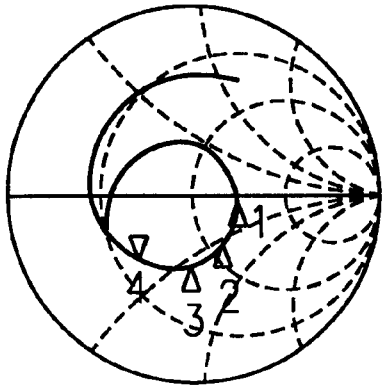
FIG. 8 is a graph showing the impedance matching state of the helical antenna formed into a conical winding coil, according to the embodiment of the present invention when it contacts a human body.
Figure 8:
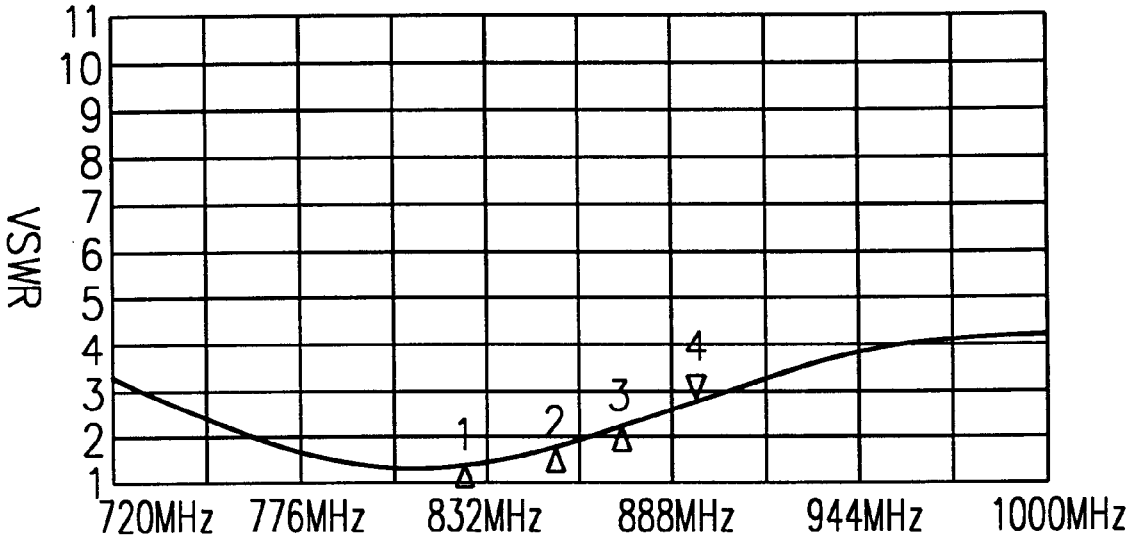

FIGS. 7 and 8 are graphs respectively showing the impedance matching states of the conventional helical antenna formed into a cylindrical winding coil (FIG. 7) and the helical antenna formed into a conical winding coil, according to the embodiment of the present invention (FIG. 8) when a user touches the caps of the helical antennas with his finger during a call.

Referring to FIG. 7, the VSWR of the conventional helical antenna is about 6. This implies that little impedance is matched and thus the conventional antenna's characteristics to operate reliably have deteriorated significantly. On the contrary, the VSWR of the helical antenna, according to the embodiment of the present invention, is 3 or below. Therefore, the deterioration of antenna characteristics caused by contact between the helical antenna and a human body is minimized or prevented in the embodiment of the present invention.

As described above, the helical antenna formed into a conical winding coil according to the embodiment of the present invention is similar to the conventional helical antenna formed into a cylindrical winding coil in terms of impedance matching states and antenna radiation characteristics in free space. Even when a human body contacts the cap of the helical antenna during a call, the helical antenna of the present invention maintains the antenna characteristics as in free space, as compared to the conventional helical antenna, which exhibits significant deterioration of its operational characteristics.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A helical the antenna structure for a mobile terminal, comprising:

a cap protruding from an upper end of the mobile terminal; and a winding coil formed within the cap, which is spaced from an outer surface of the cap substantially the same distance with respect to a bottom part of the cap to a top part of the cap.

2. The helical antenna structure of claim 1, wherein the winding coil is formed into a cone shape with a diameter decreased by a predetermined value at every turn from the bottom part to the top part of the cap.

3. A helical antenna structure for a mobile terminal, comprising:

a cap protruding from an upper end of the mobile terminal; and a winding coil disposed within the cap and formed into a cone shape with a diameter decreased by a predetermined value at every turn from a bottom part to a top part of the cap so as to be spaced from an outer surface of the cap substantially the same distance from the bottom part of the cap to the top part of the cap.

4. A helical antenna structure for a mobile terminal comprising:

a substantially conical shaped cap protruding from the terminal; and a substantially conical shaped coil disposed in said cap;

wherein a distance between an outer surface of the cap and the coil remains substantially the same from a bottom end of the cap and coil adjacent the terminal to a top end of the cap and coil remote from the terminal.

* * * * *